US005240076A

United States Patent [19]

Cromar et al.

[11] Patent Number: 5,240,076

[45] Date of Patent: * Aug. 31, 1993

[54] CASING TENSION RETAINER

[75] Inventors: Stephen A. Cromar; Eric R. Schwelm, both of Bridge of Don; Garry Stephen, Aberdeen; Norman Brammer, Turiff; Ian Calder, Aberdeen, all of Scotland

[73] Assignee: ABB Vetco Gray Inc., Houston, Tex.

[ * ] Notice: The portion of the term of this patent subsequent to Mar. 26, 2008 has been disclaimed.

[21] Appl. No.: 670,678

[22] Filed: Mar. 18, 1991

Related U.S. Application Data

[63] Continuation-in-part of Ser. No. 466,985, Jan. 18, 1990, Pat. No. 5,002,131.

[51] Int. Cl.[5] ..... E21B 43/10

[52] U.S. Cl. ..... 166/382; 166/208; 166/215

[58] Field of Search ..... 166/382, 387, 77.5, 166/124, 208, 214, 215, 217; 285/140

[56] References Cited

U.S. PATENT DOCUMENTS

| | | | |
|---|---|---|---|
| Re. 31,881 | 5/1985 | Lindsey, Jr. | 166/212 |
| 2,589,337 | 3/1952 | Burns | 166/215 X |
| 3,104,708 | 9/1963 | Orr et al. . | |
| 3,152,643 | 10/1964 | Burns | 166/208 X |
| 3,581,817 | 6/1971 | Kammerer, Jr. | 166/208 |
| 3,736,984 | 6/1973 | Garrett | 166/208 |
| 3,933,376 | 1/1976 | Cugini | 285/23 |
| 4,497,367 | 2/1985 | Stevenson | 166/215 X |
| 4,702,313 | 10/1987 | Greenlee et al. | 166/216 |
| 4,823,871 | 4/1989 | McEver et al. | 166/182 |
| 4,825,954 | 5/1989 | Baugh | 166/382 |

*Primary Examiner*—William P. Neuder
*Attorney, Agent, or Firm*—James E. Bradley

[57] ABSTRACT

A wellhead housing a supports a string of casing in tension by using a load ring. The load ring mounts to the exterior of a casing hanger which secures to the upper end of the string of casing. The load ring is split, resilient and outwardly biased. The load ring is retained during the running of the casing. The running tool then releases the load ring to spring outward to support the load. The load ring has wickers on its exterior that mate with wickers in the interior of the bore.

16 Claims, 3 Drawing Sheets

CASING TENSION RETAINER

CROSS REFERENCE TO RELATED APPLICATION

This invention is a continuation-in-part of application Ser. No. 466,985, filed Jan. 18, 1990, "Casing Hanger Load Carrying Mechanism", inventors Stephen A. Cromar, Eric R. Schwelm, and Garry Stephen, now U.S. Pat. No. 5,002,131.

BACKGROUND OF THE INVENTION

1. Field of the invention

This invention relates generally to wellhead equipment, and in particular to a mechanism for supporting a string of casing in tension within a well.

2. Description of the Prior Art

In an oil and gas well, one or more strings of casing will be cemented within the well. In one system used with offshore jack-up drilling rigs, the string of casing in the well will be supported by a mudline hanger located in a subsea housing at the sea floor. A section of the casing will extend upward to a surface wellhead housing on the drill rig. The surface wellhead housing will be located above the sea and below the rig floor. The distance from the subsea housing to the surface wellhead could be as much as 500 feet with a large jack-up drilling rig.

Cement will be pumped down the string to flow up the annulus to cement the casing in the well. The level of cement will be below the mudline hanger. In the prior art system, the casing will be cut off at the surface wellhead. The blowout preventer will be removed, and a spear will be used to pull tension on the casing after cementing. Then slips will be inserted around the casing which engage the wellhead housing and grip the casing to hold the casing in tension. A packoff will be installed between the casing hanger and the wellhead hosing.

A disadvantage of the prior art system is that the blowout preventer must be removed while installing the slips and packoff. A danger of a blowout thus exists. Also, the prior art technique is time consuming and expensive. In addition to this, the sealing mechanisms are generally elastomer or on site machined to give metal-to-metal seals.

SUMMARY OF THE INVENTION

In this invention, a load ring mounts to the exterior of the casing hanger. The load ring is split, resilient and outwardly biased. The load ring has wickers on the exterior which mesh with wickers formed in the bore of the wellhead housing.

At least one conical load shoulder is formed on the casing hanger in contact with a mating load shoulder formed in the inner diameter of the load ring. The load shoulders transmit downward load from the casing hanger to the load ring and out to the wellhead housing when the load ring is in the expanded position.

To avoid misalignment, the wickers of one set are triangular in cross section, having sharp crests. The wickers of the other set are truncated, with flat crests. Also, the split of the load ring has a notch and slot located therein. The notch and slot guide the load ring against misalignment.

As the load ring springs out into contact with the wickers in the bore of the wellhead housing while tension is applied to the casing. The load ring will grip the wellhead housing, preventing the casing hanger from moving downward. This retains the desired amount of tension in the casing below the casing hanger.

DETAILED DESCRIPTION OF THE INVENTION

Figure 1:
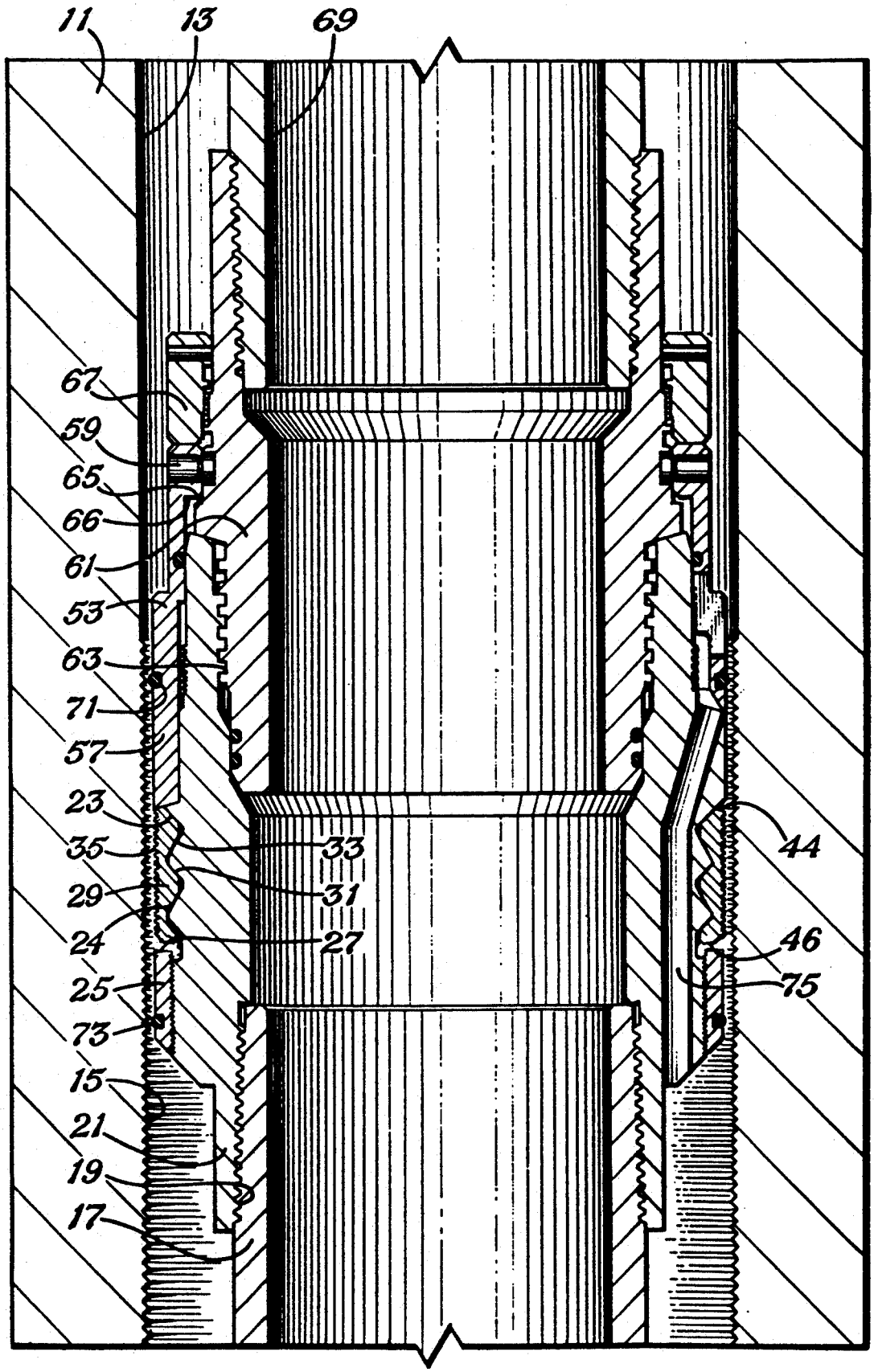
FIG. 1 is a vertical sectional view of a casing hanger having a tension retainer constructed in accordance with this invention.

Referring to FIG. 1, wellhead housing 11 will normally be located above the sea on a jackup drilling rig below the rig floor. Wellhead housing 11 has a bore 13. A set of annular teeth or wickers 15 will be formed in the bore 13. Wickers 15 are circumferential, saw tooth shaped teeth. Wickers 15 are parallel with each other and located in a plane perpendicular to the axis of bore 13. The pitch of wickers 15 is fairly small, typically about ⅛th inch.

Referring to FIG. 1*b*, a string of casing 17 may be lowered into the well below the wellhead housing 11. Casing 17 will be supported by a mudline hanger in a subsea housing (not shown). There are no seals around the casing 17 at the mudline hanger. Rather, annulus pressure around the casing 17 will be sealed at the surface wellhead housing 11. Casing 17 will be cemented in the well, with the level of cement extending no higher than the subsea housing. The distance from the subsea housing to the surface wellhead housing 11 could be as much as 500 feet.

Casing 17 secures by threads 19 to a casing hanger 21. The casing hanger 21 has a plurality of external load shoulders 23. Each load shoulder 23 is frustaconical and faces downward and outward. In the preferred embodiment, there are three of the load shoulders 23, each parallel with each other. The load shoulders 23 are separated by upper flanks 24, which are also conical and parallel with each other. The pitch of the casing hanger load shoulders 23 is much greater than the pitch of the wickers 15.

A retainer ring 25 secures to the exterior of casing hanger 21 below the load shoulders 23. Retainer ring 25 secures by threads. Retainer ring 25 has an upper shoulder 27 that is flat. An annular recess exists between upper shoulder 27 and the uppermost load shoulder 23.

A load ring 29 mounts to the casing hanger 21 within this annular recess. Load ring 29 is a resilient, metal, split ring. Load ring 29 is biased outward. If not restrained, as shown in FIG. 1, the load ring would expand outward. Load ring 29 has on its inner diameter a plurality of conical load shoulders 31.

Load shoulders 31 are parallel to each other, each facing upward and inward. Each load shoulder 31 is at the same taper as the casing hanger load shoulders 23 for mating with the casing hanger load shoulders 23. The load shoulders 31 are separated by lower flanks 33 which face downward and inward. The lower flanks 33 mate with the upper flanks 24 of the casing hanger 21.

In the retracted position shown in FIG. 1, the load shoulders 31 and lower flanks 33 will be in contact with the load shoulders 23 and upper flanks 24. When moved to the expanded position, shown in FIG. 2, a gap will exist between the upper flanks 24 and lower flanks 33. A portion of the load shoulders 31 will still be engaging the load shoulders 23. This allows weight on the casing hanger 21 to be transferred through the load shoulders 23, 31 and to the wellhead housing 11 (FIG. 1).

Figure 4:
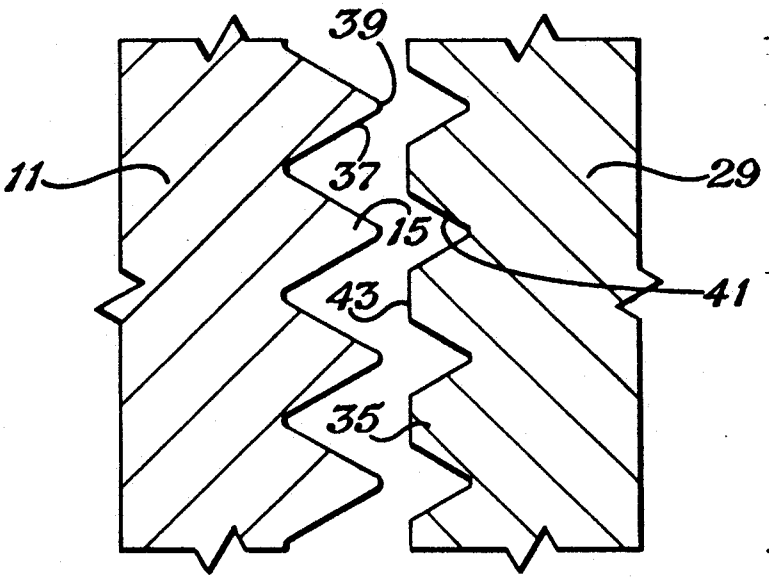
FIG. 4 is an enlarged, vertical sectional view illustrating the wickers formed on the bore of the wellhead housing and the wickers formed on the exterior of the load ring of FIG. 3.

The load ring 29 has a set of wickers 35 on its exterior. Wickers 35 have the same pitch as the bore wickers 15 for engaging the bore wickers 15. However, as shown in FIG. 4, wickers 35 have a different configuration. The bore wickers 15 have upper and lower conical flanks 37 that converge to a sharp crest 39. Crest 39 is an annular line. This results in a triangular configuration to the Wickers 15.

The load ring wickers 35 have similar upper and lower flanks 41 that are triangular. Flanks 41 incline at the same inclination as the flanks 37. However, they are truncated. They terminate in a blunt or flat crest 43. Crest 43 is a portion of a cylinder, not a line as crest 39.

The blunt crest 43 serves to avoid the wickers 35 from becoming misaligned with wickers 15 as the load ring 29 expands outward. Without the blunt crest 41, slight angular cocking of the load ring as it expands outward could result in the wickers 35 being offset from the wickers 15 by one or more of the wickers.

Figure 3:
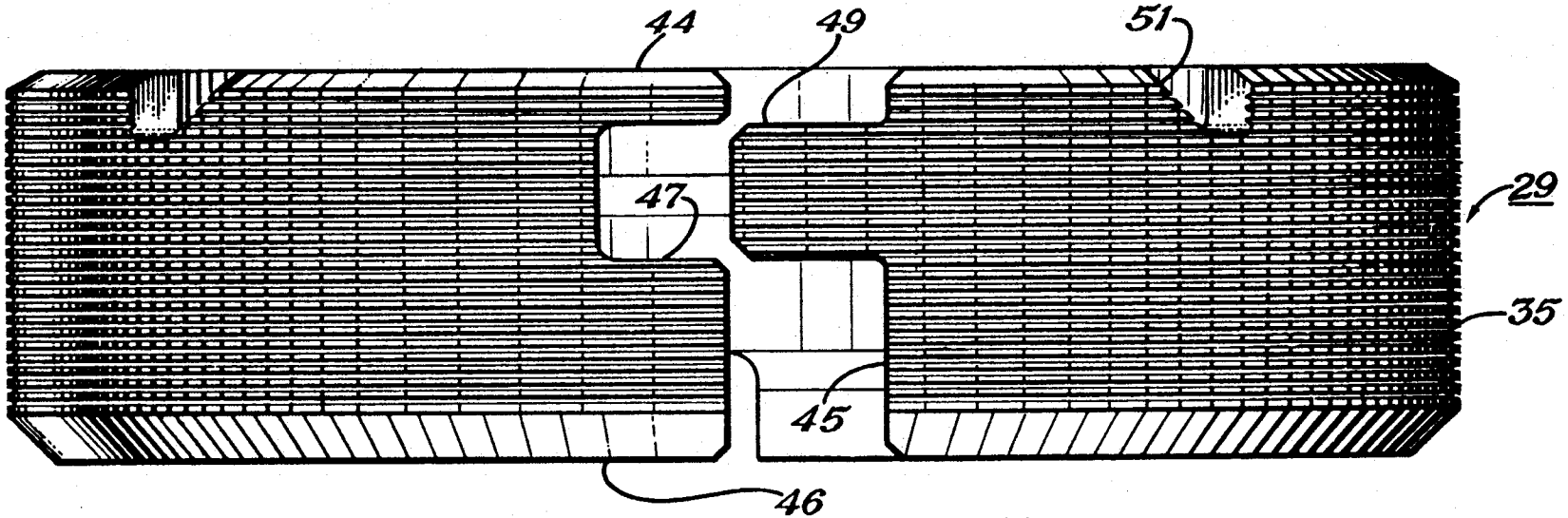
FIG. 3 is an enlarged side view of the load ring utilized with the casing retaining mechanism of FIG. 1.

Referring to FIG. 3, load ring 29 has an upper edge 44 and a lower edge 46. The lower edge 46 is flat and spaced above the retainer ring upper shoulder 27 (FIG. 1). Load ring 29 has a vertical split 45 to enable it to move between the contracted and expanded positions. Split 45 extends from the upper edge 44 to the lower edge 46 of load ring 29. A slot 47 extends circumferentially in one direction from one side of split 45. Slot 47 is located between the upper edge 44 and lower edge 46 of load ring 29. It extends a short distance circumferentially. Slot 47 is rectangular, having parallel upper and lower sides and a vertical base.

The other edge of the split 45 has a mating tab 49. Tab 49 is only slightly smaller in dimension than the split 45. Tab 49 will enter the split 45 slidingly when the ring 29 contracts to the position shown in FIG. 1. As the ring 29 expands outward, the tab 49 will serve as a guide to prevent cocking of one portion of the load ring 29 relative to the other. A plurality of notches 51 are formed on the upper edge 44 of the load ring 29. Notches 51 are spaced circumferentially around the load ring 29.

Figure 2:
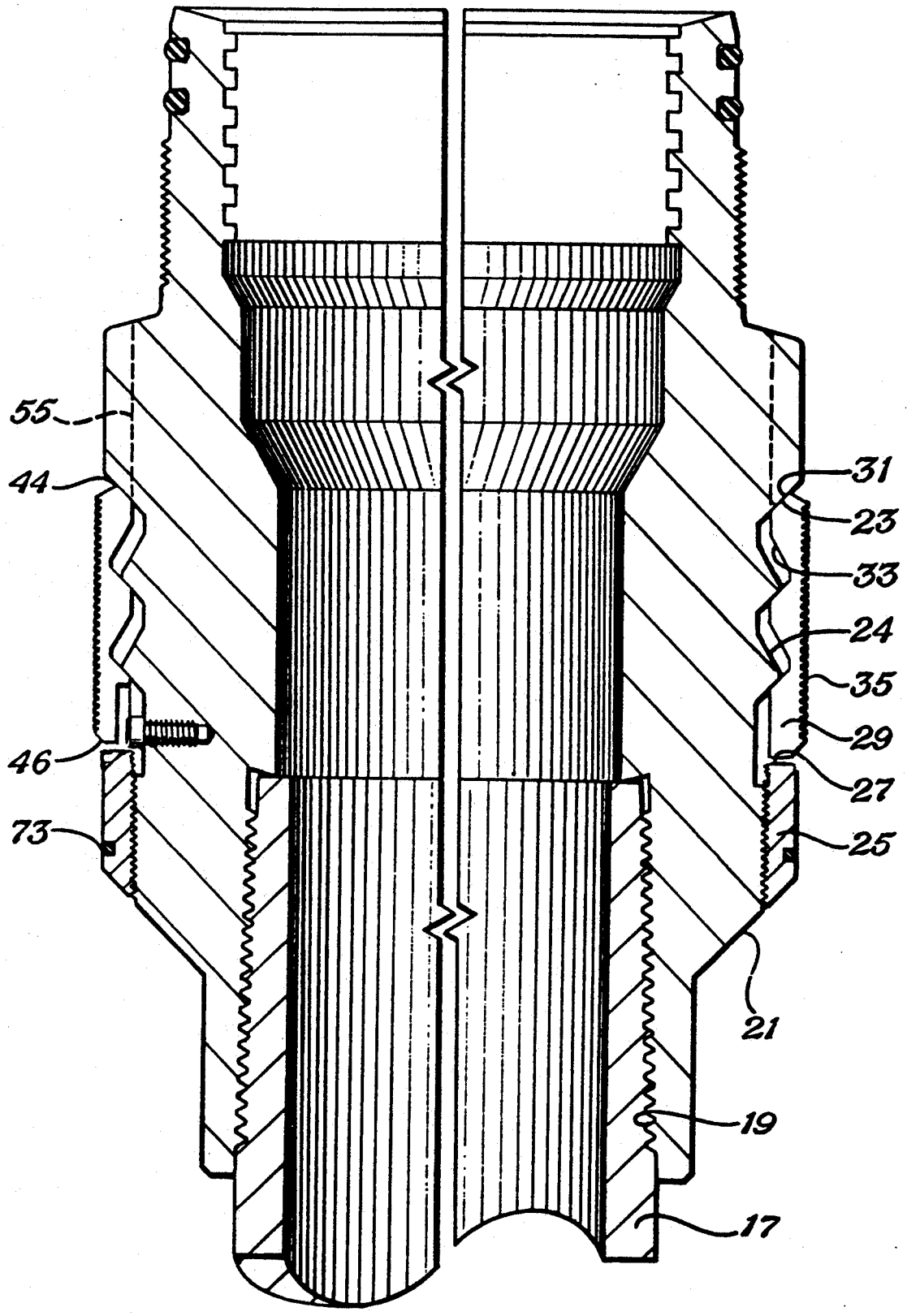
FIG. 2 is a view of the casing hanger of FIG. 1, shown outside of the wellhead housing and with the running tool removed.

Referring again to FIG. 1, a retaining means exists for retaining the load ring 29 in the contracted position as shown in FIG. 1. The retaining means includes a sleeve 53. Sleeve 53 mounts to the exterior of casing hanger 21 above the load ring 29. As shown in FIG. 2 a plurality of vertical slots 55 extend through the exterior of the casing hanger 21 from the uppermost load shoulder 23.

Each slot 55 will receive a finger 57 of the load ring 53. The fingers 57 are spaced circumferentially around the load ring 53, each sliding through one of the vertical slots 55. The right hand side of FIG. 1 does not show a finger 57 depending from sleeve 53 because of the cut of the sectional view. The lower end of each finger 57 will engage one of the notches 51 (FIG. 3) to hold the load ring 29 in the retracted position.

Sleeve 53 is initially secured by a shear pin 59 to a running tool 61. Running tool 61 secures to threads 63 formed in the bore of the casing hanger 21. The running tool 61 has an upward facing shoulder 65 located below a downward facing shoulder 66 of sleeve 53.

Once shear pin 59 is sheared, rotating running tool 61 relative to casing hanger 21 will cause it to unscrew. The shoulder 65 will contact the shoulder 66, lifting the sleeve 53. This removes the fingers 57 from contact with the notches 51 (FIG. 3) of the load ring 29. A retainer ring 67 locates above the sleeve 53 to retain the sleeve 53. Retainer ring 67 secures by threads to the exterior of running tool 61.

The running tool 61 will be lowered by a string of conduit such as drill pipe 69. Seals 71, 73 on the sleeve 53 and the retainer ring 25 serve to prevent the entry of debris. A plurality of return flow passages 75 (only one shown) extend through the casing hanger 21 inward of the load shoulders 23 for allowing the return of displaced fluid during cementing.

In operation, the casing 17 will be lowered into the well with casing hanger 21 secured to the upper end of the casing 17. Running tool 61 will be secured to the casing hanger 21. Sleeve 53 will be pinned by shear pin 59 to the running tool 61. The fingers 57 of sleeve 53 will engage the notches 51 (FIG. 3), keeping the load ring 29 in a retracted position. The lower end of a string of drill pipe 69 will be connected to the running tool 61. A mudline hanger (not shown) located in the string of casing 17 will land in the subsea housing (not shown). The mudline hanger will support the weight of the casing 17 in the well.

When the mudline hanger lands in the subsea housing, the load ring 29 will be located adjacent the bore wickers 15 of the surface wellhead housing 11. Cement will then be pumped down the string of casing 17. The cement returns up the annulus around the casing 17 to a selected level. Displaced drilling mud will flow up the annulus and through the return passages 75.

The running tool 61 is then rotated to shear the shear pin 59. After the cementation has been completed, the casing 17 is tensioned up to the desired amount by pulling on the drill pipe 69. Once tensioned, the running tool 61 is rotated or backed out three turns. Running tool shoulder 65 will contact sleeve shoulder 66 to pull the sleeve 53 straight upward. The fingers 57 (FIG. 1) will disengage from the notches 51 (FIG. 3), but remain within the slots 55 (FIG. 2). This allows the load ring 29 to spring out to the extended position. The load ring wickers 35 will engage the bore wickers 15.

The notches 51 (FIG. 3) will rotate a short distance from their initial position due to the natural movement occurring the expansion. When this happens, the notches 51 will no longer be in vertical alignment with the fingers 57 of sleeve 53. The running tool 61 is then rotated in the opposite direction to move the sleeve 53 back downward. The retainer ring 67 will contact the upper end of sleeve 53 to push it downward as the running tool 61 screws further into the threads 63.

The fingers 57 of sleeve 53 will not contact the notches 51 if the load ring 29 has properly expanded out, because of the rotational movement of the notches 51 that occurs during the expansion movement. Consequently, the operator will be able to rotate the running tool 61 only about one turn in the downward direction even though he rotated three turns when moving upward. The operator will detect an increase in torque after only one turn. This informs the operator that the load ring 29 has fully expanded out. The operator may then rotate again in the unscrewing direction to remove the running tool 61. As it rotates, the shoulder 65 will contact the shoulder 66, retrieving the sleeve 53.

The tension in the casing 17 will be retained by the gripping action of the load ring 29 with the bore wickers 15. Downward load transmits through the load shoulders 23, 31 and from there to the wellhead housing 11.

The invention has significant advantages. The blunt crest of one set of the wickers reduces the chances for misalignment during the expansion procedure. The notch and slot also provide guiding during the expansion procedure. The notches on the upper edge for engagement by the fingers provide a positive means to inform the operator that the ring has fully expanded.

While the invention has been shown in only one of its forms, it should be apparent to those skilled in the art that it is not so limited, but is susceptible to various changes without departing from the scope of the invention.

We claim:

1. In a wellhead housing having an axial bore, an apparatus for supporting a string of casing, comprising in combination:

a set of parallel annular wickers formed in the bore of the wellhead housing;

a casing hanger having a lower end secured to the string of casing;

a load ring mounted to the exterior of the casing hanger, the load ring being split, resilient and outwardly biased for movement between a retracted position and an expanded position in engagement with the wellhead housing;

a set of parallel annular wickers formed on the load ring for meshing with the wickers in the bore of the wellhead housing when the load ring moves to the expanded position;

a conical load shoulder formed on the casing hanger for contact with the load ring when the load ring moves to the expanded position, to transmit downward load on the casing hanger through the load ring to the wellhead housing; and retaining means for retaining the load ring in the retracted position until the casing hanger reaches a selected position in the wellhead housing, then for releasing the load ring to engage the wellhead housing to support the casing hanger with the casing in tension.

2. The apparatus according to claim 1 wherein the wickers of one of the sets of wickers are triangular in cross-section, having sharp crests, and the wickers of the other of the sets of wickers are triangular and truncated in cross-section, but have flat crests, to reduce the chances for misalignment.

3. The apparatus according to claim 1 wherein a plurality of notches are formed in the upper end of the load ring, and wherein the retaining means has fingers which engage the notches

4. In a wellhead housing having an axial bore, an apparatus for supporting a string of casing, comprising in combination:

a set of parallel annular wickers formed in the bore of the wellhead housing;

a casing hanger having a lower end secured to the string of casing;

an annular recess on the exterior of the casing hanger, the recess having a plurality of downward and outward facing load shoulders spaced axially apart from each other;

a load ring mounted to the exterior of the casing hanger, the load ring having a split and being resilient and outwardly biased for movement between a retracted position and an expanded position in engagement with the wellhead housing, the load ring having an upper end and a lower end;

the load ring having an inner diameter having a plurality of upward and inward facing load shoulders which mate with the load shoulders of the recess to transmit downward load on the casing hanger through the load ring to the wellhead housing when the load ring moves to the expanded position;

a set of parallel annular wickers formed on the load ring which mesh with the wickers in the bore of the wellhead housing when the load ring moves to the expanded position; and retaining means for retaining the load ring in the retracted position until the casing hanger reaches a selected position in the wellhead housing, then for releasing the load ring to engage the wellhead housing to support the casing hanger with the casing in tension.

5. The apparatus according to claim 4 wherein the load shoulders of the recess are parallel to each other.

6. The apparatus according to claim 4 wherein the pitch of the wickers is substantially smaller than the pitch of the load shoulders of the recess.

7. The apparatus according to claim 4, further comprising:

a slot extending from one edge of the split a selected circumferential distance, the slot being located between the upper and lower ends of the load ring and having a axial dimension; and a tab formed on the other edge of the split and extending into the slot, the tab having substantially the same axial dimension as the slot to reduce any tendency of the load ring to incline as it moves to the expanded position.

8. The apparatus according to claim 4 wherein the retaining means comprises:

a sleeve extending around the casing hanger, having a lower end which extends into contact with the load ring for preventing the load ring from moving outward from the retracted position; and means for moving the sleeve upward relative to the casing hanger for removing the sleeve from contact with the load ring.

9. In a wellhead housing having an axial bore, an apparatus for supporting a string of casing, comprising in combination:

a set of parallel annular wickers formed in the bore of the wellhead housing;

a casing hanger having a lower end secured to the string of casing;

a conical downward and outward facing upper casing hanger load shoulder;

at least one downward and outward facing additional casing hanger load shoulder located below and parallel to the upper casing hanger load shoulder;

a vertical slot extending through the upper conical casing hanger load shoulder;

a load ring mounted to the exterior of the casing hanger, the load ring having a split and being resilient and outwardly biased for movement between a retracted position and an expanded position in engagement with the wellhead housing, the load ring having an upper end and a lower end;

the load ring having an inner diameter having a plurality of parallel conical load shoulders that mate with the casing hanger load shoulders to transmit downward load on the casing hanger through the load ring to the wellhead housing when the load ring moves to the expanded position;

a set of parallel annular wickers formed on the load ring for meshing with the wickers in the bore of the wellhead housing when the load ring moves to the expanded position;

a sleeve extending around the casing hanger, having a finger on its lower end which extends through the vertical slot into contact with the load ring for preventing the load ring from moving outward from the retracted position; and means for moving the sleeve upward relative to the casing hanger for removing the sleeve from contact with the load ring.

10. The apparatus according to claim 9 wherein at least one notch is formed in the upper end of the load ring for engagement by the finger.

11. The apparatus according to claim 9 wherein one of the sets of wickers comprises wickers that are triangular in cross-section, having sharp crests, and the other of the sets of wickers comprises wickers that are triangular and truncated in cross-section, having flat crests, to reduce the chances for misalignment.

12. The apparatus according to claim 9 wherein the pitch of the wickers is substantially smaller than the pitch of the load shoulders of the recess.

13. The apparatus according to claim 9, further comprising:

a slot extending from one edge of the split a selected circumferential distance, the slot being located between the upper and lower ends of the load ring and having a axial dimension; and a tab formed on the other edge of the split and extending into the slot, the tab having substantially the same axial dimension as the slot to reduce any tendency of the load ring to incline as it moves to the expanded position.

14. In a wellhead housing having an axial bore, an apparatus for supporting a string of casing, comprising in combination:

a set of parallel annular wickers formed in the bore of the wellhead housing;

a casing hanger having a lower end secured to the string of casing;

a conical downward and outward facing upper casing hanger load shoulder;

at least one downward and outward facing additional casing hanger load shoulder located below and parallel to the upper casing hanger load shoulder;

a vertical slot extending through the upper conical casing hanger load shoulder;

a load ring mounted to the exterior of the casing hanger, the load ring having a split and being resilient and outwardly biased for movement between a retracted position and an expanded position in engagement with the wellhead housing, the load ring having an upper end and a lower end;

the load ring having an inner diameter having a plurality of parallel conical load shoulders that mate with the casing hanger load shoulders to transmit downward load on the casing hanger through the load ring to the wellhead housing when the load ring moves to the expanded position;

a set of parallel annular wickers formed on the load ring for meshing with the wickers in the bore of the wellhead housing when the load ring moves to the expanded position;

one of the sets of wickers having wickers that are triangular in cross-section, having sharp crests, and the other of the sets of wickers having wickers that are triangular and truncated in cross-section, with flat crests, to reduce the chances for misalignment;

at least one notch formed in the upper end of the load ring;

a sleeve extending around the casing hanger, having a finger on its lower end which extends through the vertical slot into contact with the notch on the upper end of the load ring for preventing the load ring from moving outward from the retracted position;

means for moving the sleeve upward relative to the casing hanger for removing the sleeve from contact with the load ring;

a slot extending from one edge of the split a selected circumferential distance, the slot being located between the upper and lower ends of the load ring and having a axial dimension; and a tab formed on the other edge of the split and extending into the slot, the tab having substantially the axial dimension a the slot to reduce any tendency of the load ring to incline as it moves to the expanded position.

15. In an outer housing having an axial bore, an apparatus for supporting an inner member, comprising in combination:

a set of parallel annular wickers formed in the bore of the outer housing;

a ring mounted to the exterior of the inner member, the ring being split and resilient for movement between an inner position and an outer position in engagement with the outer housing;

a set of parallel annular wickers formed on the ring for meshing with the wickers in the bore of the outer housing when the ring moves to the expanded position; and the wickers of one of the sets of wickers being triangular in cross-section, having sharp crests, and the wickers of the other of the sets of wickers being triangular and truncated in cross-section, but having flat crests, to reduce the chances for misalignment.

16. The apparatus according to claim 15 wherein the pitches of the sets of wickers are the same.

* * * * *